US007037190B2

(12) United States Patent
Moody et al.

(10) Patent No.: US 7,037,190 B2
(45) Date of Patent: May 2, 2006

(54) ELECTRONIC MULTI-HAND STUD POKER GAMES WITH PAYOUT MULTIPLIERS

(76) Inventors: Ernest W. Moody, 2116 Redbird Dr., Las Vegas, NV (US) 89134; Michael W. Wood, 1106 Willowbrook Ave., Denham Springs, LA (US) 70726

( * ) Notice: Subject to any disclaimer, the term of this patent is extended or adjusted under 35 U.S.C. 154(b) by 345 days.

(21) Appl. No.: 10/015,108

(22) Filed: Dec. 11, 2001

(65) Prior Publication Data

US 2003/0119572 A1 Jun. 26, 2003

(51) Int. Cl.
*A63F 1/00* (2006.01)

(52) U.S. Cl. ..... 463/16; 273/274

(58) Field of Classification Search ..... 273/274, 273/292; 463/11–13, 16
See application file for complete search history.

(56) References Cited

U.S. PATENT DOCUMENTS 5,823,873 A * 10/1998 Moody ..... 463/13
6,007,066 A * 12/1999 Moody ..... 273/292
6,050,568 A * 4/2000 Hachquet ..... 273/292
6,098,985 A * 8/2000 Moody ..... 273/292
6,132,311 A * 10/2000 Williams ..... 463/13
6,419,578 B1 * 7/2002 Moody et al. ..... 463/13
6,474,645 B1 * 11/2002 Tarantino ..... 273/274
6,561,898 B1 * 5/2003 Moody ..... 463/13

* cited by examiner

*Primary Examiner*—Vishu K. Mendiratta
(74) *Attorney, Agent, or Firm*—John Edward Roethel

(57) ABSTRACT

A player makes a wager to play multiple hands of a stud poker game. A plurality of initial partial hands are displayed to the player. Each initial partial hand has the same cards with the cards displayed face up to the player. Each hand is then completed as a stud poker final hand. The player wins or loses depending on the poker hand ranking of each final hand. If the player achieves two or more final hands of the same poker hand ranking, the amount won by the player is increased, preferably as multiples of the original payout amounts.

15 Claims, 2 Drawing Sheets

ELECTRONIC MULTI-HAND STUD POKER GAMES WITH PAYOUT MULTIPLIERS

This invention relates primarily to electronic video poker games, and more particularly to electronic video stud poker games that are based on poker hand rankings and allow the player to play multiple hands at the same time. The player starts with five identical partial hands and then each hand is completed by displaying additional cards so that each hand is a final stud poker hand. If the player achieves two or more final hands with the same poker ranking, the player wins multiplier payouts.

BACKGROUND OF THE INVENTION

Five card, six card and seven card stud have been played for many years, usually in a poker room setting in which a plurality of players play against each other striving to obtain the highest ranking poker hand (or lowest ranking poker hand in Lo-Ball poker) in order to win the pot which comprises the wagers made by the players during the play of the game.

Electronic video poker has also been a staple in gaming casinos for many years and this well known game is a single player game based on draw poker. The player attempts to achieve a winning poker hand ranking by discarding from an initial five card hand and drawing new cards in order to try and improve his poker hand. A pay table is provided to show the player what he can win based on the poker hand ranking achieved after the draw step and the amount wagered by the player.

There have been attempts to adapt stud poker to an electronic video game format. One attempt involved a single player seven card stud game in which the player makes a first wager and initially received three cards face up. In one version of this game, the player has the option of making additional wagers before the player receives the fourth, fifth, sixth and seventh cards. In another version, the player also has the option of making additional wagers before receiving the fourth, fifth, sixth and seventh cards unless the player has already achieved a winning poker hand combination, in which case the player is not allowed to make additional wagers. In either version, the final seven cards are analyzed and the best five card hand is used to determine the poker hand ranking of the player's hand. A pay table is used based on five card poker hand rankings and the amount wagered by the player to determine the amount won by the player when he achieves a winning hand.

Another popular single player stud poker game is known as DOUBLE DOWN STUD poker. This game is described in U.S. Pat. No. 5,100,137 and U.S. Pat. No. 5,167,413, the disclosures of each of which are incorporated herein by this reference. In DOUBLE DOWN STUD poker, the player makes a first wager and is dealt four cards all face up. The player may make an additional wager prior to receiving the fifth card. After the fifth card is dealt, the five card hand is compared to a pay table to determine if the player has a winning or losing card combination based on poker hand ranking.

It is an object of the present invention to provide a multi-hand format to stud poker games that awards the player higher payouts based on multipliers of the basic pay table for achieving two or more final hands of the same poker ranking.

It is a feature of the present invention to deal and display multiple partial hands to the player, preferably three, four or five partial hands, each partial hand having the same cards.

Each partial hand is then completed into a final stud hand by dealing and displaying additional cards to each hand. The poker hand ranking of each final stud hand is determined and winning final hands are paid based on the poker hand ranking of the final stud hand and the amount wagered by the player. If the player achieves two or more final hands with the same poker hand ranking, then the player wins additional payouts which are multiples of the basic payout amounts.

It is an advantage of the present invention that very large payouts may be achieved by the player when playing multiple stud poker hands which will increase the appeal of the game to the player as well as provide an increase in game revenue to the casino from the increased volume of wagering.

Other objects, features and advantages of the present invention will become apparent from a consideration of the following detailed description.

SUMMARY OF THE INVENTION

The method of present invention involves the player making a wager to play multiple hands of a stud poker game. The gaming machine is configured to allow the player to play a fixed number of hands or the player selects the number of hands that the player wishes to play. The wager is allocated among the number of hands that are to be played.

Once the player has made his wager, a plurality of initial partial hands are displayed to the player. Each initial partial hand has the same cards with the cards displayed face up to the player. The initial partial hand are randomly dealt from a single deck of playing cards. Each hand is then completed as a stud poker final hand by dealing the additional cards from either the original single deck of cards (less the initially dealt cards) or from a plurality of partial depleted decks of playing cards, each depleted deck of playing cards comprising a full deck less the cards dealt as the initial partial hand.

The player wins or loses depending on the poker hand ranking of each final hand. The amount won by the player is based on the poker hand ranking of each final hand and the amount wagered by the player according to a pay table. If the player achieves two or more final hands of the same poker hand ranking, the amount won by the player is increased, preferably as multiples of the original payout amounts.

In the preferred embodiment of the present invention, each initial partial hand has four cards and the final hand has five cards and the player plays three, four or five hands at once. In other variations of the present invention, each initial partial hand can have one, two or three cards and the final hand has five cards. In yet other variations of the present invention, the final hand can have three, four, six, seven or more cards and the initial partial hand would then have less cards than the final hand.

DETAILED DESCRIPTION OF THE PREFERRED EMBODIMENTS

The present invention includes a variety of electronic video stud poker games. Each electronic video stud poker game is designed to be played by having the hands to be played by the player displayed on a video screen.

Figure 1:
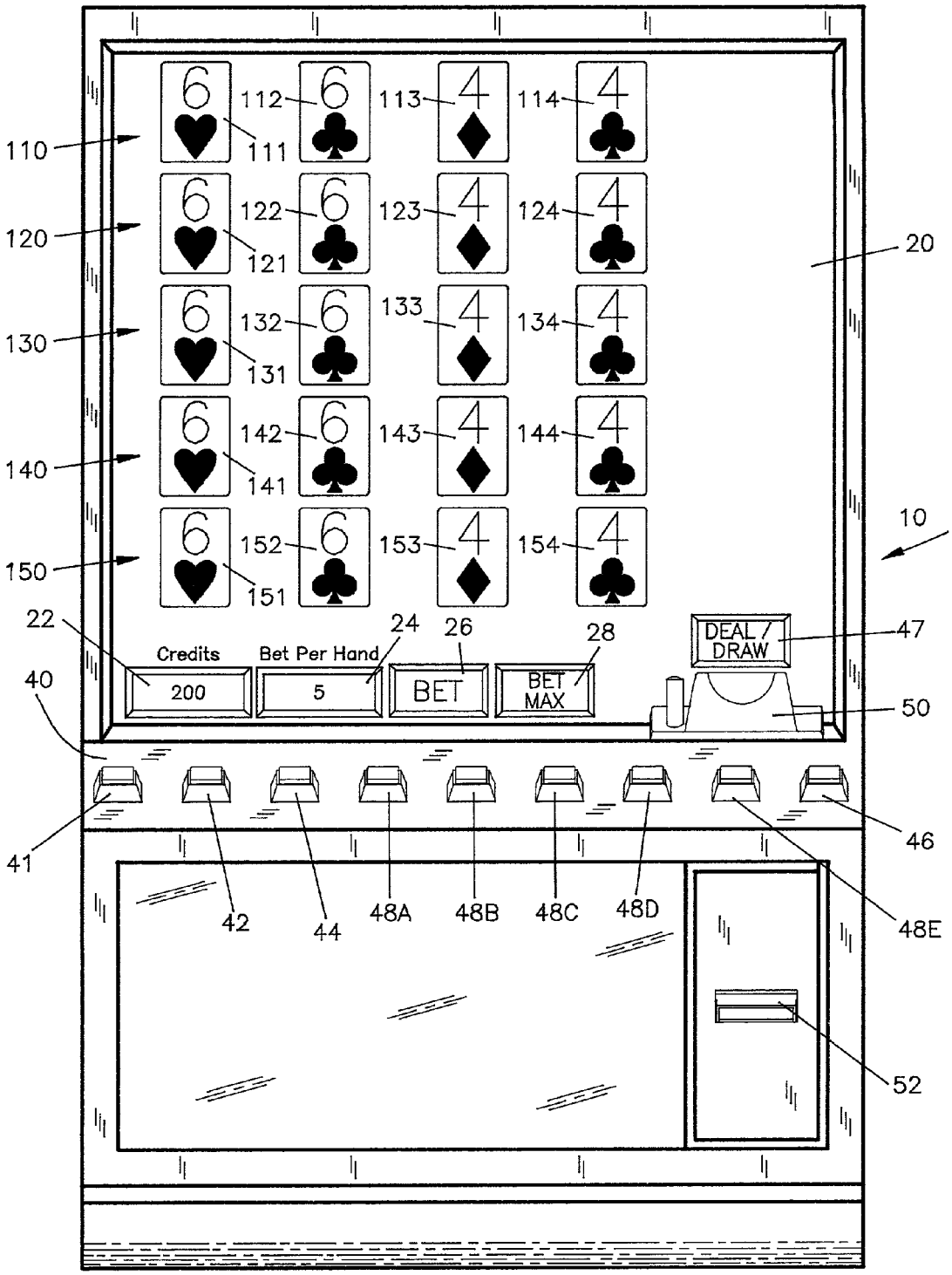
FIG. 1 shows a gaming machine configured to practice the method of present invention and also showing a representative initial deal for Version #1.

FIG. 1 shows a gaming machine upon which the method of the present invention can be carried out. The gaming machine 10 includes a video screen display 20 on which is shown the playing cards that will be used during the play of the method of the present invention. The video screen display 20 also includes other information and data presented to the player to allow the player to understand the play of the game and to effect the operation of the method.

In the preferred embodiment of the present invention, the video screen display 20 shows a credit meter 22 and a display of the "bet per hand" 24 which is the number of credits wagered on each hand for a particular round of play of the game. The video screen display also has a DEAL/DRAW touch screen location to allow the player to cause the initial deal of the cards to be displayed on the video screen display 20. Other touch screen locations allow the player to make his initial wager, which can be made one credit at a time using the BET ONE location 26 or which can be made by wagering the maximum number of credits allowed by the gaming machine using the BET MAX location 28.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allows the player to wager either the maximum amount of credits or to wager one credit at a time on the play of the game as desired by the player, if the player wishes to use buttons to place his wager instead of using the touch screen locations 26 and 28 to place his wager. A DEAL/DRAW button 46 is provided to allow the player to effect the initial deal step of the method of play as desired should the player prefer to use the button panel instead of the DEAL/DRAW screen location 47 on the video screen display 20.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine, is mounted a bill acceptor which takes in and validates the currency. The monetary value of the inserted currency is then applied to the credit meter 22, the credits on which the player may use to play the gaming machine.

A plurality of buttons 48 can also be provided on the button panel 40 to allow the player to select the number of hands which the player wishes to play. For example, TWO HAND button 48A allows the player to select to play two hands. THREE HAND button 48B allows the player to select to play three hands. FOUR HAND button 48C allows the player to select to play four hands. FIVE HAND button 48D allows the player to select to play five hands. TEN HAND button 48E allows the player to select to play ten hands. Any suitable distribution of the number of hands can be allocated to the buttons and fewer or more than five buttons 48 can be used.

Instead of using buttons on the button panel, the video screen display 20 can be provided with touch screen locations (not shown) that the player would touch to select the number of hands that the player wishes to play.

Any other conventional and suitable equipment can be included in the gaming machine.

Version #1

Version #1 of the present invention uses a standard fifty-two card deck of playing cards. A player makes an initial wager to activate the game and the player selects the number of hands that the player wishes to play during that round of the game. The player also determines the amount of the wager that is to be allocated to each hand of cards that the player will play.

For example, the player may make a wager of twenty-five credits and select to play five hands of cards. In the preferred embodiment of the present invention, the computer controls of the gaming machine will allocate five credits to each hand the player has selected to play. Alternatively, the computer controls could prompt the player to input the amount the player wishes to play on each hand.

After the wager is made and after the deck of playing cards has been electronically shuffled, a first partial hand of four cards is randomly dealt and displayed face up to the player on the screen display. These same four cards by suit and rank are also displayed in each of the other partial hands that the player has selected to play, which following the example, would be the second hand, the third hand, the fourth hand and the fifth hand. Thus, in this example, the player starts with five identical partial hands of four cards all displayed face up.

FIG. 1 shows on the video screen display 20 the first partial hand 110, the second partial hand 120, the third partial hand 130, the fourth partial hand 140 and the fifth partial hand 150 with the same four cards shown face up. In the example shown in FIG. 1, the four face up initial cards are the Six of Hearts (111, 121, 131, 141 and 151), the Six of Clubs (112, 122, 132, 142 and 152), the Four of Diamonds (113, 123, 133, 143 and 153) and the Four of Clubs (114, 124, 134, 144 and 154).

The computer controls of the gaming machine 10 then proceed to the next step of the method in which the fifth card in each hand is dealt and displayed to the player. In one embodiment of the present invention, the fifth card for each hand is dealt from the depleted deck of forty eight cards (which represent the cards remaining from the original fifty-two card deck less the four initially dealt cards). In this embodiment, the depleted forty-eight card deck is reshuffled electronically before the fifth card is dealt to complete each hand.

In another embodiment of the present invention, the fifth card for the first hand 110 is dealt from the depleted deck of forty eight cards (which represent the cards remaining from the original fifty-two card deck less the four initially dealt cards). The fifth card for the second hand 120 is dealt from the further depleted deck of forty-seven cards (which represent the cards remaining from the original fifty-two card deck less the four initially dealt cards and the fifth card dealt to the first hand 110). The fifth card for the third hand 130 is dealt from the further depleted deck of forty-six cards (which represent the cards remaining from the original fifty-two card deck less the four initially dealt cards, the fifth card dealt to the first hand 110 and the fifth card dealt to the second hand 120). The fifth card for the fourth hand 140 is dealt from the further depleted deck of forty-five cards (which represent the cards remaining from the original fifty-two card deck less the four initially dealt cards, the fifth card dealt to the first hand 110, the fifth card dealt to the second hand 120 and the fifth card dealt to the third hand 130). The fifth card for the fifth hand 150 is dealt from the further depleted deck of forty-four cards (which represent the cards remaining from the original fifty-two card deck less the four initially dealt cards, the fifth card dealt to the first hand 110, the fifth card dealt to the second hand 120, the fifth card dealt to the third hand 130 and the fifth card dealt to the fourth hand 140). In this embodiment, the cards of each of the depleted decks may or may not be electronically reshuffled before displaying the fifth card to complete each hand.

Figure 2:
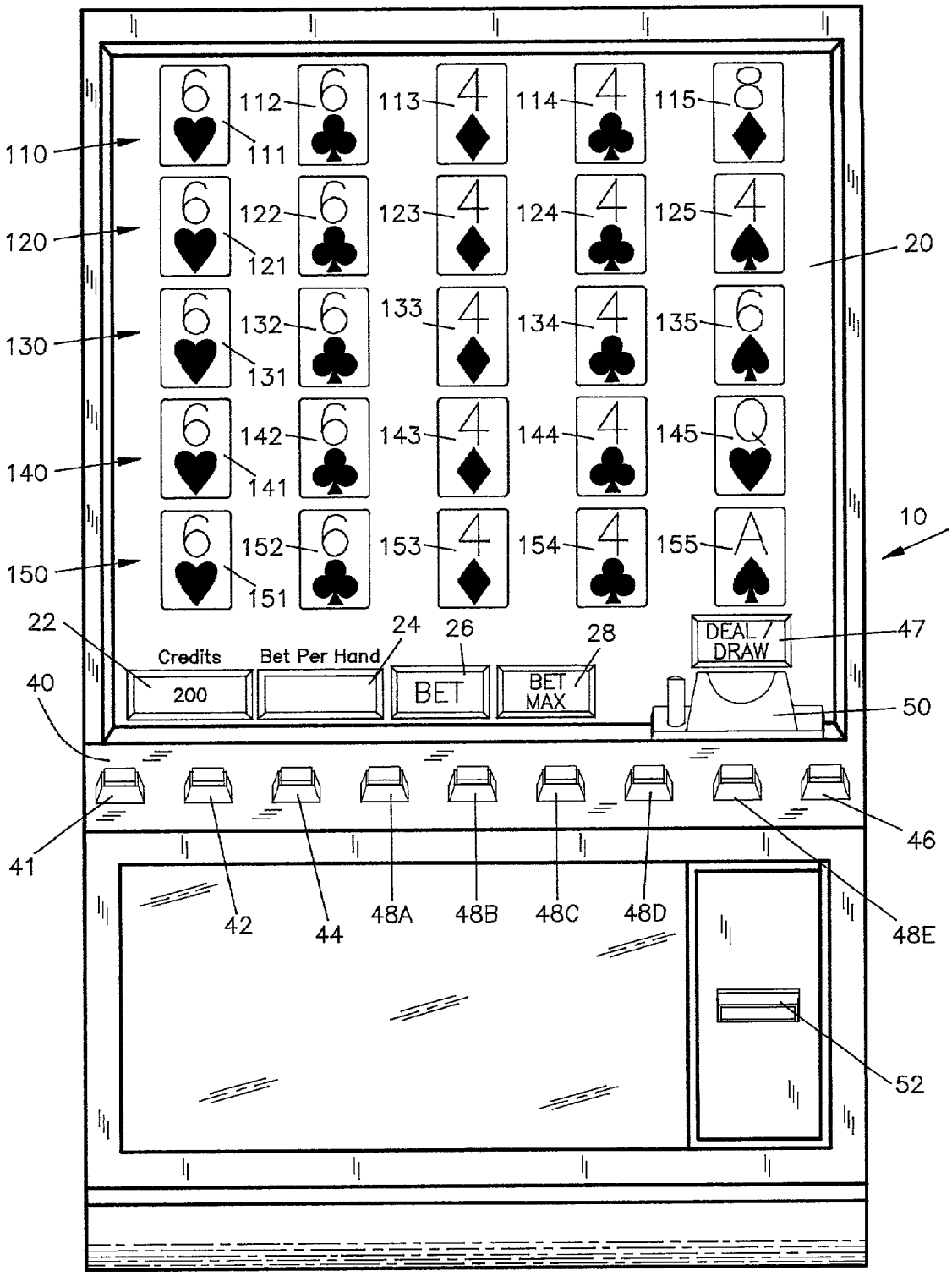
FIG. 2 shows the screen display for Version #1 of the present invention showing a representative result that could occur during the play of the game.

FIG. 2 shows an example of how the hands may be completed by the display of the fifth card. First hand 110 could result in the Six of Hearts 111, the Six of Clubs 112, the Four of Diamonds 113, the Four of Clubs 114 and the Eight of Diamonds 115. The poker hand ranking of the first hand 110 is Two Pair. Second hand 120 could result in the Six of Hearts 121, the Six of Clubs 122, the Four of Diamonds 123, the Four of Clubs 124 and the Four of Spades 125. The poker hand ranking of the second hand 120 is a Full House. Third hand 130 could result in the Six of Hearts 131, the Six of Clubs 132, the Four of Diamonds 133, the Four of Clubs 134 and the Six of Spades 135. The poker hand ranking of the third hand 130 is a Full House. Fourth hand 140 could result in the Six of Hearts 141, the Six of Clubs 142, the Four of Diamonds 143, the Four of Clubs 144 and the Queen of Hearts 145. The poker hand ranking of the fourth hand 140 is Two Pair. Finally, fifth hand 150 could result in the Six of Hearts 151, the Six of Clubs 152, the Four of Diamonds 153, the Four of Clubs 154 and the Ace of Spades 155. The poker hand ranking of the fifth hand 150 is Two Pair.

Any suitable poker hand combinations can be designated was winning and losing hand combinations. The amount won by the player is determined according to a pay table based on the poker hand combination achieved by the player and the amount wagered by the player. Additionally, the player wins additional payouts for achieving multiple hands of the same poker rank.

Typically, the base pay tables are determined based on the mathematical probability of certain poker combinations occurring during the play of the game and based on the desired theoretical hold percentage to be kept by the gaming establishment. Any suitable base pay table may be used and a representative pay table is shown in Table 1. The base pay table is used in combination with the multipliers used for achieving multiple hands of the same poker rank.

TABLE 1

| POKER HAND COMBINATION | PAYOUT ODDS |
|---|---|
| Less than Pair of 7's | Losing Hand |
| Pair of 7's thru Aces | 1 for 1 |
| Two Pair | 3 for 1 |
| Three of a Kind | 4 for 1 |
| Straight | 6 for 1 |
| Flush | 9 for 1 |
| Full House | 12 for 1 |
| Four of a Kind-5's thru Kings | 50 for 1 |
| Four of a Kind-2's, 3's and 4's | 80 for 1 |
| Four of a Kind-Aces | 160 for 1 |
| Four 2's, 3's or 4's with an Ace, 2, 3 or 4 | 160 for 1 |
| Four Aces with a 2, 3 or 4 | 400 for 1 |
| Straight Flush | 50 for 1 |
| Royal Flush | 800 for 1 |

The payouts to the player for winning hand combinations are then increased by multipliers for achieving multiple hands of the same rank. Table 2 show the multiplier pay table:

TABLE 2

| POKER HAND RANKING | PAY MULTIPLIER | | | |
|---|---|---|---|---|
| NUMBER OF SAME HAND ENDINGS | 2 | 3 | 4 | 5 |
| Less than Pair of 7's | 0 | 0 | 0 | 0 |
| Pair of 7's thru Aces | 0 | 2 | 2 | 2 |
| Two Pair | 0 | 2 | 2 | 2 |
| Three of a Kind | 2 | 2 | 2 | 2 |
| Straight | 2 | 3 | 4 | 5 |
| Flush | 2 | 3 | 4 | 5 |
| Full House | 2 | 3 | 4 | 5 |
| Four of a Kind-5's thru Kings | 2 | 3 | 4 | 5 |
| Four of a Kind-2's, 3's and 4's | 2 | 3 | 4 | 5 |
| Four of a Kind-Aces | 2 | 3 | 4 | 5 |
| Four 2's, 3's or 4's with an Ace, 2, 3 or 4 | 2 | 3 | 4 | 5 |
| Four Aces with a 2, 3 or 4 | 2 | 3 | 4 | 5 |
| Straight Flush | 2 | 3 | 4 | 10 |
| Royal Flush | 2 | 3 | 4 | 10 |

The computer controls of the gaming machine 10 determine how many of the final five card hands have the same poker hand ranking and any winning amounts are multiplied by the pay multiplier associated with the number of same hand endings. For example, if the final hands were all straight flushes, then the pay multiplier would be 10 and the amount awarded to the player in the base pay table for each Straight Flush would be increased by 10 times.

With reference to FIG. 2 which shows a representative outcome of the play of five hands, the player had wagered five credits on each hand. The player achieved two Full Houses (Hand 120 and Hand 130). Using the base pay table in Table 1, the player would receive 60 credits for each Full House. The player also achieved three Two Pair (Hand 110, Hand 140 and Hand 150). The player would receive 15 credits for each Two Pair. The total award to the player from the base pay table would be 165 credits (60+60+15+15+15).

Referring now to the pay multipliers shown in Table 2, the player had two Full Houses which earned the player a pay multiplier of 2. The total award of 165 credits is now multiplied by 2. The player also had three Two Pair which earned the player another pay multiplier of 2. So the total award of 165 is again multiplied by 2. The final total award to the player is 660 credits (165×2×2).

As the representative game outcome shows, it is possible for the player to achieve more than one pay multiplier in the same round of play of the game.

Any suitable arrangement of pay multipliers can be used based on the mathematical probability of the occurrence of the various ending hands and the overall game return desired by the operator of the gaming machine.

Version #2.

Version #2 of the present invention is similar to Version #1, but in Version #2 the player plays four stud poker hands. As in Version #1, Version #2 uses a standard fifty-two card deck of playing cards. A player makes an initial wager of twenty credits to activate the game and the player selects to play four hands of cards. In the preferred embodiment of the present invention, the computer controls of the gaming machine will allocate five credits to each hand the player has selected to play. Alternatively, the computer controls could prompt the player to input the amount the player wishes to play on each hand.

After the wager is made and after the deck of playing cards has been electronically shuffled, a first partial hand of four cards is randomly dealt and displayed face up to the player on the screen display. These same four cards by suit and rank are also displayed in each of the other partial hands that the player has selected to play, which following the example, would be the second hand, the third hand and the fourth hand. Thus, in this example, the player starts with four identical partial hands of four cards all displayed face Up.

The computer controls of the gaming machine 10 then proceed to the next step of the method in which the fifth card in each hand is dealt and displayed to the player. In one embodiment of the present invention, the fifth card for each hand is dealt from the depleted deck of forty eight cards (which represent the cards remaining from the original fifty-two card deck less the four initially dealt cards). In this embodiment, the depleted forty-eight card deck is reshuffled electronically before the fifth card is dealt to complete each hand.

In another embodiment of the present invention, the fifth card for the first hand is dealt from the depleted deck of forty eight cards (which represent the cards remaining from the original fifty-two card deck less the four initially dealt cards). The fifth card for the second hand is dealt from the further depleted deck of forty-seven cards (which represent the cards remaining from the original fifty-two card deck less the four initially dealt cards and the fifth card dealt to the first hand). The fifth card for the third hand is dealt from the further depleted deck of forty-six cards (which represent the cards remaining from the original fifty-two card deck less the four initially dealt cards, the fifth card dealt to the first hand and the fifth card dealt to the second hand). Finally, the fifth card for the fourth hand is dealt from the further depleted deck of forty-five cards (which represent the cards remaining from the original fifty-two card deck less the four initially dealt cards, the fifth card dealt to the first hand, the fifth card dealt to the second hand and the fifth card dealt to the third hand). In this embodiment, the cards of each of the depleted decks may or may not be electronically reshuffled before displaying the fifth card to complete each hand.

Any suitable poker hand combinations can be designated was winning and losing hand combinations. The amount won by the player is determined according to a pay table based on the poker hand combination achieved by the player and the amount wagered by the player. Additionally, the player wins additional payouts for achieving multiple hands of the same poker rank.

Typically, the base pay tables are determined based on the mathematical probability of certain poker combinations occurring during the play of the game and based on the desired theoretical hold percentage to be kept by the gaming establishment. Any suitable base pay table may be used and a representative pay table for Version #2 is shown in Table 3. The base pay table is used in combination with the multipliers used for achieving multiple hands of the same poker rank.

TABLE 3

| POKER HAND COMBINATION | PAYOUT ODDS |
|---|---|
| Less than Pair of 6's | Losing Hand |
| Pair of 6's thru Aces | 1 for 1 |
| Two Pair | 3 for 1 |
| Three of a Kind | 4 for 1 |
| Straight | 6 for 1 |
| Flush | 9 for 1 |
| Full House | 12 for 1 |
| Four of a Kind-5's thru Kings | 50 for 1 |
| Four of a Kind-2's, 3's and 4's | 80 for 1 |
| Four of a Kind-Aces | 160 for 1 |
| Four 2's, 3's or 4's with an Ace, 2, 3 or 4 | 160 for 1 |
| Four Aces with a 2, 3 or 4 | 400 for 1 |

TABLE 3-continued

| POKER HAND COMBINATION | PAYOUT ODDS |
|---|---|
| Straight Flush | 200 for 1 |
| Royal Flush | 800 for 1 |

The payouts to the player for winning hand combinations are then increased by multipliers for achieving multiple hands of the same rank. Table 4 show the multiplier pay table for this Version #2:

TABLE 4

| POKER HAND RANKING | PAY MULTIPLIER | | |
|---|---|---|---|
| NUMBER OF SAME HAND ENDINGS | 2 | 3 | 4 |
| Less than Pair of 6's | 0 | 0 | 0 |
| Pair of 6's thru Aces | 0 | 2 | 2 |
| Two Pair | 0 | 2 | 2 |
| Three of a Kind | 0 | 2 | 2 |
| Straight | 2 | 3 | 5 |
| Flush | 2 | 3 | 5 |
| Full House | 2 | 3 | 5 |
| Four of a Kind-5's thru Kings | 2 | 3 | 5 |
| Four of a Kind-2's, 3's and 4's | 2 | 3 | 5 |
| Four of a Kind-Aces | 2 | 3 | 5 |
| Four 2's, 3's or 4's with an Ace, 2, 3 or 4 | 2 | 3 | 5 |
| Four Aces with a 2, 3 or 4 | 2 | 3 | 5 |
| Straight Flush | 3 | 5 | 10 |
| Royal Flush | 3 | 5 | 10 |

The computer controls of the gaming machine 10 determine how many of the final five card hands have the same poker hand ranking and any winning amounts are multiplied by the pay multiplier associated with the number of same hand endings. For example, if the final hands were all straight flushes, then the pay multiplier would be 10 and the amount awarded to the player in the base pay table for each Straight Flush would be increased by 10 times.

It is possible for the player to achieve more than one pay multiplier in the same round of play of the game. For example, the player could finish with 2 Straights and 2 Flushes which would result in the total award from the base pay table being multiplied four times (2×2).

Any suitable arrangement of pay multipliers can be used based on the mathematical probability of the occurrence of the various ending hands and the overall game return desired by the operator of the gaming machine.

Version #3.

Version #3 of the present invention is similar to Version #1 and Version #2, but in Version #3 the player plays three stud poker hands. As in the other versions, Version #3 uses a standard fifty-two card deck of playing cards. A player makes an initial wager of fifteen credits to activate the game and the player selects to play three hands of cards. In the preferred embodiment of the present invention, the computer controls of the gaming machine will allocate five credits to each hand the player has selected to play. Alternatively, the computer controls could prompt the player to input the amount the player wishes to play on each hand.

After the wager is made and after the deck of playing cards has been electronically shuffled, a first partial hand of four cards is randomly dealt and displayed face up to the player on the screen display. These same four cards by suit and rank are also displayed in each of the other partial hands that the player has selected to play, which following the example, would be the second hand and the third hand. Thus, in this example, the player starts with three identical partial hands of four cards all displayed face up.

The computer controls of the gaming machine 10 then proceed to the next step of the method in which the fifth card in each hand is dealt and displayed to the player. In one embodiment of the present invention, the fifth card for each hand is dealt from the depleted deck of forty eight cards (which represent the cards remaining from the original fifty-two card deck less the four initially dealt cards). In this embodiment, the depleted forty-eight card deck is reshuffled electronically before the fifth card is dealt to complete each hand.

In another embodiment of the present invention, the fifth card for the first hand is dealt from the depleted deck of forty eight cards (which represent the cards remaining from the original fifty-two card deck less the four initially dealt cards). The fifth card for the second hand is dealt from the further depleted deck of forty-seven cards (which represent the cards remaining from the original fifty-two card deck less the four initially dealt cards and the fifth card dealt to the first hand). Finally, the fifth card for the third hand is dealt from the further depleted deck of forty-six cards (which represent the cards remaining from the original fifty-two card deck less the four initially dealt cards, the fifth card dealt to the first hand and the fifth card dealt to the second hand). In this embodiment, the cards of each of the depleted decks may or may not be electronically reshuffled before displaying the fifth card to complete each hand.

Any suitable poker hand combinations can be designated was winning and losing hand combinations. The amount won by the player is determined according to a pay table based on the poker hand combination achieved by the player and the amount wagered by the player. Additionally, the player wins additional payouts for achieving multiple hands of the same poker rank.

Typically, the base pay tables are determined based on the mathematical probability of certain poker combinations occurring during the play of the game and based on the desired theoretical hold percentage to be kept by the gaming establishment. Any suitable base pay table may be used and a representative pay table for Version #3 is shown in Table 5. The base pay table is used in combination with the multipliers used for achieving multiple hands of the same poker rank.

TABLE 5

| POKER HAND COMBINATION | PAYOUT ODDS |
|---|---|
| Less than Pair of 7's | Losing Hand |
| Pair of 7's thru Aces | 1 for 1 |
| Two Pair | 3 for 1 |
| Three of a Kind | 4 for 1 |
| Straight | 6 for 1 |
| Flush | 9 for 1 |
| Full House | 12 for 1 |
| Four of a Kind-5's thru Kings | 50 for 1 |
| Four of a Kind-2's, 3's and 4's | 80 for 1 |
| Four of a Kind-Aces | 160 for 1 |
| Four 2's, 3's or 4's with an Ace, 2, 3 or 4 | 160 for 1 |
| Four Aces with a 2, 3 or 4 | 400 for 1 |
| Straight Flush | 50 for 1 |
| Royal Flush | 800 for 1 |

The payouts to the player for winning hand combinations are then increased by multipliers for achieving multiple hands of the same rank. Table 6 show the multiplier pay table for this Version #3:

TABLE 6

| POKER HAND RANKING | PAY MULTIPLIER | |
|---|---|---|
| NUMBER OF SAME HAND ENDINGS | 2 | 3 |
| Less than Pair of 7's | 0 | 0 |
| Pair of 7's thru Aces | 2 | 2 |
| Two Pair | 2 | 2 |
| Three of a Kind | 2 | 2 |
| Straight | 3 | 5 |
| Flush | 3 | 5 |
| Full House | 3 | 5 |
| Four of a Kind-5's thru Kings | 3 | 5 |
| Four of a Kind-2's, 3's and 4's | 3 | 5 |
| Four of a Kind-Aces | 3 | 5 |
| Four 2's, 3's or 4's with an Ace, 2, 3 or 4 | 3 | 5 |
| Four Aces with a 2, 3 or 4 | 3 | 5 |
| Straight Flush | 3 | 10 |
| Royal Flush | 3 | 10 |

The computer controls of the gaming machine 10 determine how many of the final five card hands have the same poker hand ranking and any winning amounts are multiplied by the pay multiplier associated with the number of same hand endings. For example, if the final hands were all straight flushes, then the pay multiplier would be 10 and the amount awarded to the player in the base pay table for each Straight Flush would be increased by 10 times.

Any suitable arrangement of pay multipliers can be used based on the mathematical probability of the occurrence of the various ending hands and the overall game return desired by the operator of the gaming machine.

Modifications to any of the versions of the present invention would include designating certain cards as wild cards or adding one or more Jokers to the standard deck and using the Jokers as wild cards. This would allow the use of other suitable base pay tables such as those used for Deuces Wild Poker or Jokers Wild Poker. Just as base pay tables can be computed mathematically, the pay multiplier tables can also be computed mathematically for methods of play that include Jokers added to the deck or that use other cards designated as wild cards.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a stud poker card game comprising:

a) the player making a wager to play at least five stud poker hands;

b) dealing and displaying face up at least five partial hands of four cards each, each partial hand having the same cards;

c) dealing and displaying face up one additional card to each hand so that each final stud poker hand has five cards;

d) determining the poker hand ranking of each final stud poker hand;

e) awarding the player a pre-established amount based on a base pay table for each final stud poker hand that has a winning poker hand ranking; and f) multiplying the amount awarded to the player by pre-established multipliers based on the number of same poker hand rankings achieved by the player among the final stud poker hands.

2. The method of claim 1 in which the additional cards for each final hand are dealt from a depleted deck which consists of the original deck of cards less the cards dealt as the partial hand.

3. The method of claim 1 in which all of the additional cards for each final hand are dealt from the same original deck of cards less the cards dealt as the partial hand.

4. The method of claim 1 in which the base pay table comprises:

| POKER HAND COMBINATION | PAYOUT ODDS |
|---|---|
| Less than Pair of 7's | Losing Hand |
| Pair of 7's thru Aces | 1 for 1 |
| Two Pair | 3 for 1 |
| Three of a Kind | 4 for 1 |
| Straight | 6 for 1 |
| Flush | 9 for 1 |
| Full House | 12 for 1 |
| Four of a Kind-5's thru Kings | 50 for 1 |
| Four of a Kind-2's, 3's and 4's | 80 for 1 |
| Four of a Kind-Aces | 160 for 1 |
| Four 2's, 3's or 4's with an Ace, 2, 3 or 4 | 160 for 1 |
| Four Aces with a 2, 3 or 4 | 400 for 1 |
| Straight Flush | 50 for 1 |
| Royal Flush | 800 for 1. |

5. The method of claim 4 in which the pay multipliers comprise:

| POKER HAND RANKING | PAY MULTIPLIER | | | |
|---|---|---|---|---|
| NUMBER OF SAME HAND ENDINGS | 2 | 3 | 4 | 5 |
| Less than Pair of 7's | 0 | 0 | 0 | 0 |
| Pair of 7's thru Aces | 0 | 2 | 2 | 2 |
| Two Pair | 0 | 2 | 2 | 2 |
| Three of a Kind | 2 | 2 | 2 | 2 |
| Straight | 2 | 3 | 4 | 5 |
| Flush | 2 | 3 | 4 | 5 |
| Full House | 2 | 3 | 4 | 5 |
| Four of a Kind-5's thru Kings | 2 | 3 | 4 | 5 |
| Four of a Kind-2's, 3's and 4's | 2 | 3 | 4 | 5 |
| Four of a Kind-Aces | 2 | 3 | 4 | 5 |
| Four 2's, 3's or 4's with an Ace, 2, 3 or 4 | 2 | 3 | 4 | 5 |
| Four Aces with a 2, 3 or 4 | 2 | 3 | 4 | 5 |
| Straight Flush | 2 | 3 | 4 | 10 |
| Royal Flush | 2 | 3 | 4 | 10. |

6. A method of playing a stud poker card game comprising:

a) the player making a wager to play at least four stud poker hands;

b) dealing and displaying face up at least four partial hands of four cards each, each partial hand having the same cards;

c) dealing and displaying face up one additional card to each hand so that each final stud poker hand has five cards;

d) determining the poker hand ranking of each final stud poker hand;

e) awarding the player a pre-established amount based on a base pay table for each final stud poker hand that has a winning poker hand ranking; and f) multiplying the amount awarded to the player by pre-established multipliers based on the number of same poker hand rankings achieved by the player among the final stud poker hands.

7. The method of claim 6 in which the additional cards for each final hand are dealt from a depleted deck which consists of the original deck of cards less the cards dealt as the partial hand.

8. The method of claim 6 in which all of the additional cards for each final hand are dealt from the same original deck of cards less the cards dealt as the partial hand.

9. The method of claim 6 in which the base pay table comprises:

| POKER HAND COMBINATION | PAYOUT ODDS |
|---|---|
| Less than Pair of 6's | Losing Hand |
| Pair of 6's thru Aces | 1 for 1 |
| Two Pair | 3 for 1 |
| Three of a Kind | 4 for 1 |
| Straight | 6 for 1 |
| Flush | 9 for 1 |
| Full House | 12 for 1 |
| Four of a Kind-5's thru Kings | 50 for 1 |
| Four of a Kind-2's, 3's and 4's | 80 for 1 |
| Four of a Kind-Aces | 160 for 1 |
| Four 2's, 3's or 4's with an Ace, 2, 3 or 4 | 160 for 1 |
| Four Aces with a 2, 3 or 4 | 400 for 1 |
| Straight Flush | 200 for 1 |
| Royal Flush | 800 for 1. |

10. The method of claim 9 in which the pay multipliers comprise:

| POKER HAND RANKING | PAY MULTIPLIER | | |
|---|---|---|---|
| NUMBER OF SAME HAND ENDINGS | 2 | 3 | 4 |
| Less than Pair of 6's | 0 | 0 | 0 |
| Pair of 6's thru Aces | 0 | 2 | 2 |
| Two Pair | 0 | 2 | 2 |
| Three of a Kind | 0 | 2 | 2 |
| Straight | 2 | 3 | 5 |
| Flush | 2 | 3 | 5 |
| Full House | 2 | 3 | 5 |
| Four of a Kind-5's thru Kings | 2 | 3 | 5 |
| Four of a Kind-2's, 3's and 4's | 2 | 3 | 5 |
| Four of a Kind-Aces | 2 | 3 | 5 |
| Four 2's, 3's or 4's with an Ace, 2, 3 or 4 | 2 | 3 | 5 |
| Four Aces with a 2, 3 or 4 | 2 | 3 | 5 |
| Straight Flush | 3 | 5 | 10 |
| Royal Flush | 3 | 5 | 10. |

11. A method of playing a stud poker card game comprising:

a) the player making a wager to play at least three stud poker hands;

b) dealing and displaying face up at least three partial hands of four cards each, each partial hand having the same cards;

c) dealing and displaying face up one additional card to each hand so that each final stud poker hand has five cards;

d) determining the poker hand ranking of each final stud poker hand;

e) awarding the player a pre-established amount based on a base pay table for each final stud poker hand that has a winning poker hand ranking; and f) multiplying the amount awarded to the player by pre-established multipliers based on the number of same poker hand rankings achieved by the player among the final stud poker hands.

12. The method of claim 11 in which the additional cards for each final hand are dealt from a depleted deck which consists of the original deck of cards less the cards dealt as the partial hand.

13. The method of claim 11 in which all of the additional cards for each final hand are dealt from the same original deck of cards less the cards dealt as the partial hand.

14. The method of claim 11 in which the base pay table comprises:

| POKER HAND COMBINATION | PAYOUT ODDS |
|---|---|
| Less than Pair of 7's | Losing Hand |
| Pair of 7's thru Aces | 1 for 1 |
| Two Pair | 3 for 1 |
| Three of a Kind | 4 for 1 |
| Straight | 6 for 1 |
| Flush | 9 for 1 |
| Full House | 12 for 1 |
| Four of a Kind-5's thru Kings | 50 for 1 |
| Four of a Kind-2's, 3's and 4's | 80 for 1 |
| Four of a Kind-Aces | 160 for 1 |
| Four 2's, 3's or 4's with an Ace, 2, 3 or 4 | 160 for 1 |
| Four Aces with a 2, 3 or 4 | 400 for 1 |
| Straight Flush | 50 for 1 |
| Royal Flush | 800 for 1. |

15. The method of claim 14 in which the pay multipliers comprise:

| POKER HAND RANKING | PAY MULTIPLIER | |
|---|---|---|
| NUMBER OF SAME HAND ENDINGS | 2 | 3 |
| Less than Pair of 7's | 0 | 0 |
| Pair of 7's thru Aces | 2 | 2 |
| Two Pair | 2 | 2 |
| Three of a Kind | 2 | 2 |
| Straight | 3 | 5 |
| Flush | 3 | 5 |
| Full House | 3 | 5 |
| Four of a Kind-5's thru Kings | 3 | 5 |
| Four of a Kind-2's, 3's and 4's | 3 | 5 |
| Four of a Kind-Aces | 3 | 5 |
| Four 2's, 3's or 4's with an Ace, 2, 3 or 4 | 3 | 5 |
| Four Aces with a 2, 3 or 4 | 3 | 5 |
| Straight Flush | 3 | 10 |
| Royal Flush | 3 | 10. |

* * * * *